United States Patent [19]

Sarto

[11] 4,110,416

[45] Aug. 29, 1978

[54] SONIC THROTTLE FOR AUTOMOBILE

[75] Inventor: Jorma O. Sarto, Orchard Lake, Mich.

[73] Assignee: Chrysler Corporation, Highland Park, Mich.

[21] Appl. No.: 807,099

[22] Filed: Jun. 16, 1977

[51] Int. Cl.[2] ..... F02M 9/14

[52] U.S. Cl. ..... 261/23 A; 251/282; 261/41 D; 261/44 D; 261/48; 261/DIG. 56; 261/DIG. 78

[58] Field of Search ..... 261/23 A, 41 D, DIG. 78, 261/48, DIG. 56, 44 D; 251/282

[56] References Cited

U.S. PATENT DOCUMENTS

| | | | |
|---|---|---|---|
| 882,170 | 3/1908 | Schmidt | 251/282 |
| 1,134,365 | 4/1915 | Barnes | 261/DIG. 78 |
| 1,973,362 | 9/1934 | Weiertz et al. | 261/DIG. 78 |
| 1,983,255 | 12/1934 | Wahlmark | 261/DIG. 78 |
| 2,315,847 | 4/1943 | Garretson | 261/23 A |
| 2,609,187 | 9/1952 | Scott | 261/23 A |
| 2,633,868 | 4/1953 | Berhoudar | 251/282 |
| 2,703,217 | 3/1955 | Ashton et al. | 251/282 |
| 3,814,389 | 6/1974 | August | 261/DIG. 78 |
| 3,953,548 | 4/1976 | Knapp et al. | 261/DIG. 78 |
| 3,965,221 | 6/1976 | Englert et al. | 261/DIG. 78 |
| 4,044,077 | 8/1977 | Gupta | 261/DIG. 78 |

FOREIGN PATENT DOCUMENTS

| | | | |
|---|---|---|---|
| 922,203 | 6/1947 | France | 261/DIG. 78 |
| 1,278,291 | 6/1972 | United Kingdom | 261/23 A |
| 133,175 | 10/1919 | United Kingdom | 261/23 A |

*Primary Examiner*—Tim R. Miles
*Attorney, Agent, or Firm*—Baldwin & Newtson

[57] ABSTRACT

A separate throttle within each of a pair of air inlet passages for an automobile internal combustion engine comprises a variable restriction diffuser designed for sonic velocity gas flow through its region of maximum restriction throughout substantially the entire operating range of the engine. The diffuser in one of the pair of passages comprises a movable orifice member and a fixed closure member. The diffuser in the other of said passages comprises a fixed orifice member and a movable closure member. The movable members in the two passages are movable in axially opposite direction with respect to the inlet air flow to vary the aforesaid maximum restriction for their respective passages and are operatively coupled with the throttle control linkage to effect such movement simultaneously, whereby the force required to move either movable diffuser member against the force of the flow of inlet fuel and air within its passage is counterbalanced by an oppositely directed force exerted by said flow on the other movable diffuser member.

15 Claims, 8 Drawing Figures

FIG. 1.
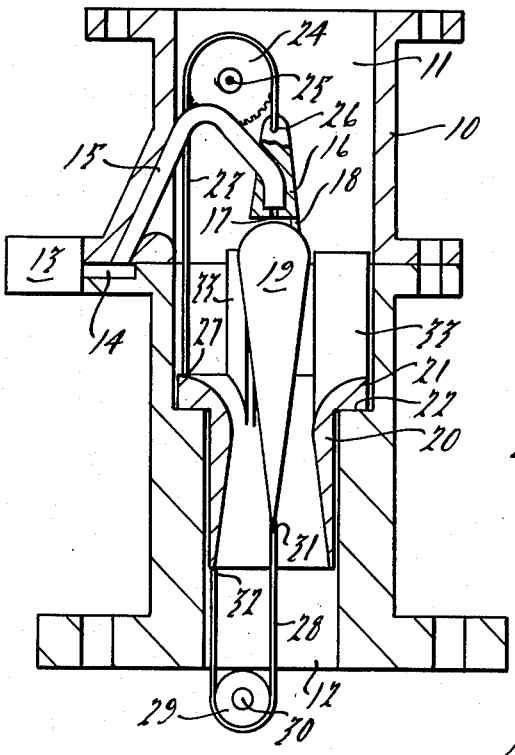
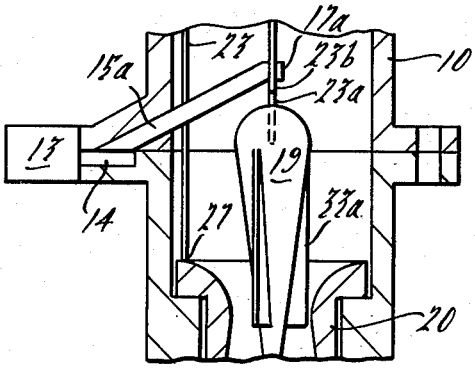
FIG. 2.
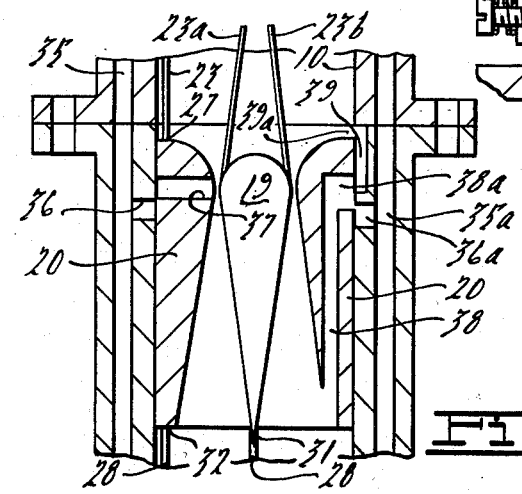
FIG. 3.
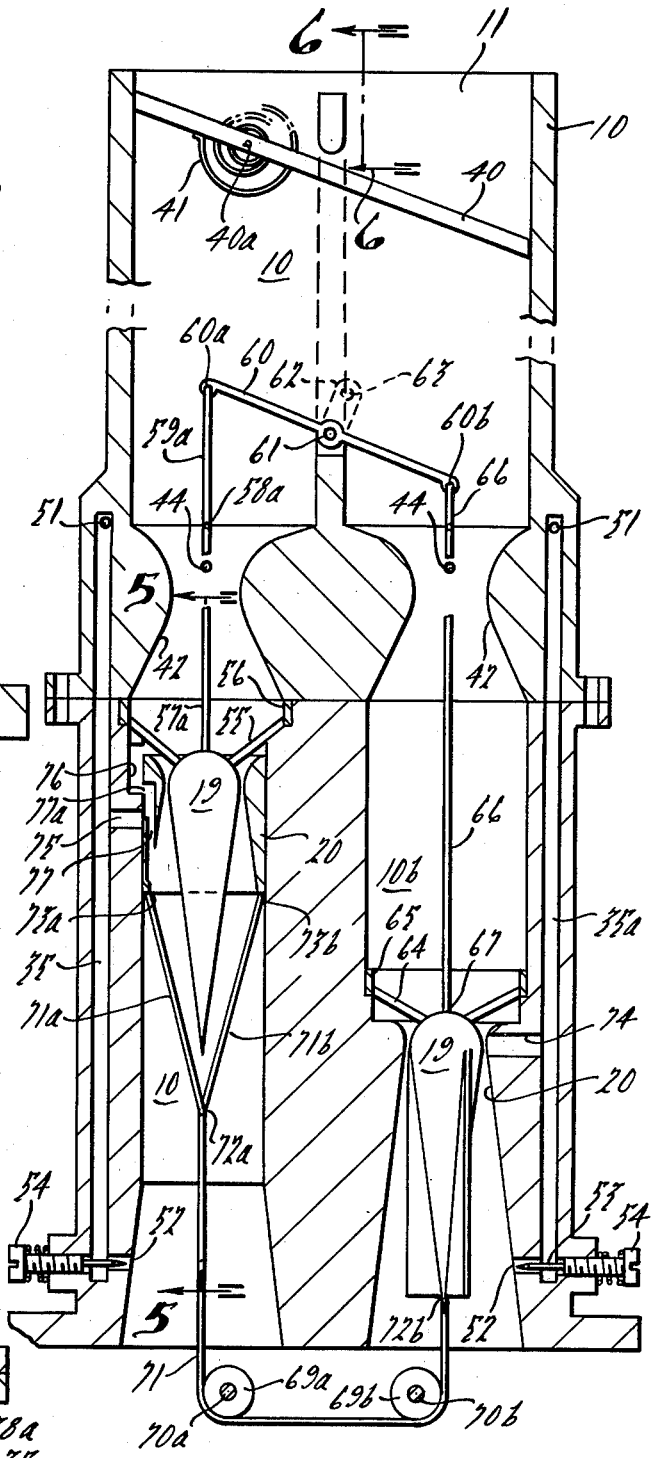
FIG. 4.

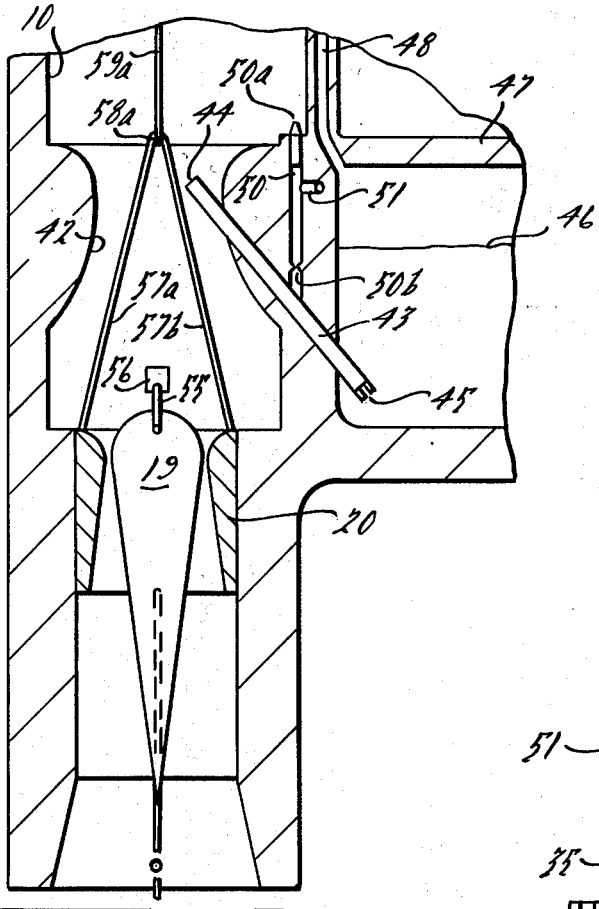
FIG. 5.
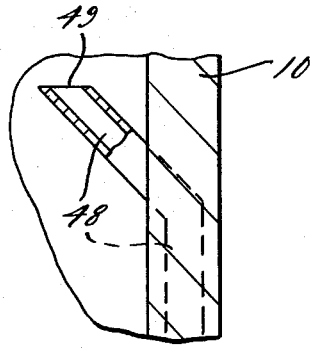
FIG. 6.
FIG. 7.
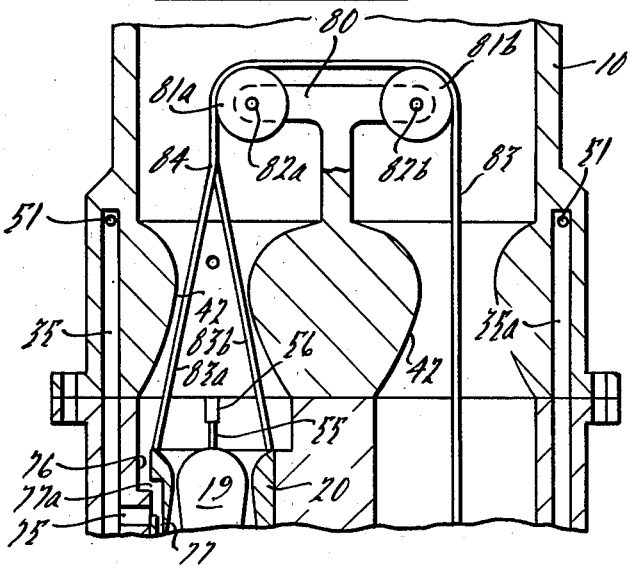
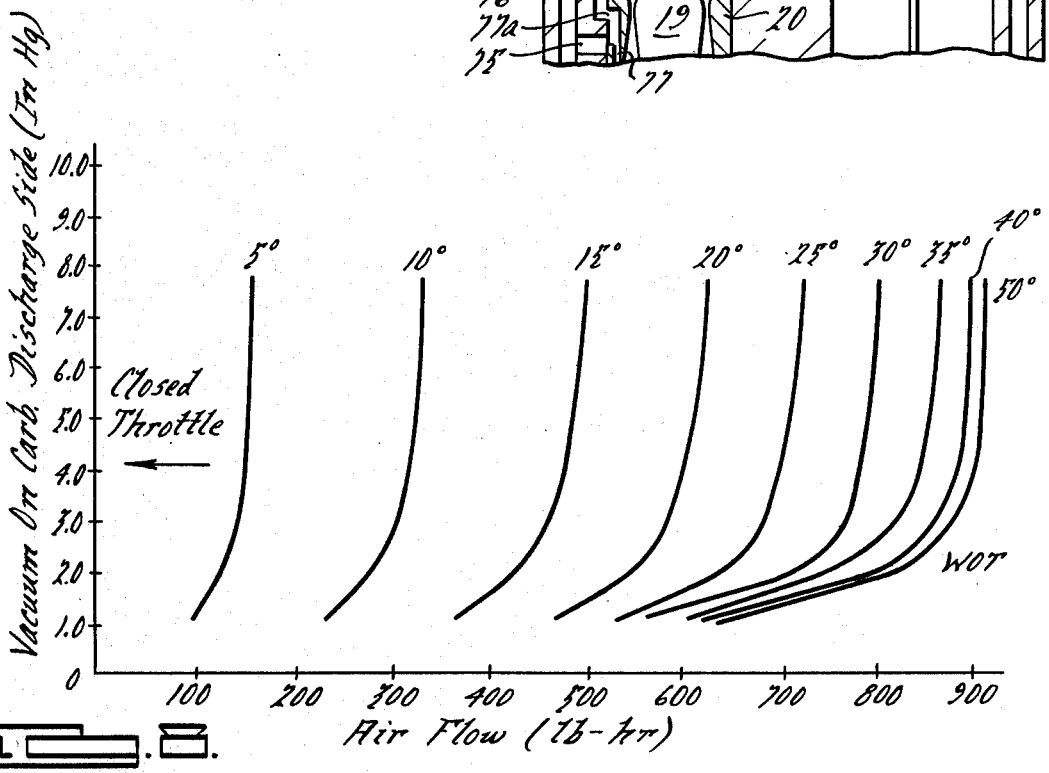
FIG. 8.

SONIC THROTTLE FOR AUTOMOBILE

BACKGROUND AND OBJECTS OF THE INVENTION

This invention relates to throttle means for controlling the flow of liquid fuel for an internal combustion engine and for atomizing or breaking-up and mixing the fuel with air to effect a homogeneous dispersion of fine fuel droplets in a gaseous fuel-air mixture to facilitate complete evaporation of the fuel prior to combustion in the engine.

A primary object is to provide essentially symmetrical throttle means comprising a pair of throttle members such as an annulus or orifice member and a coaxial closure member relatively movable axially with respect to each other and shaped to vary the effective opening of the orifice member by the relative movement.

Another object is to provide such throttle means shaped to comprise a variable restriction diffuser for effecting gas flow at sonic velocity therethrough at its region of maximum restriction throughout a comparatively wide range of positions of the relatively movable throttle members corresponding to all operating conditions of the engine from idle to near wide open throttle.

Other objects are to provide symmetrical throttle means of the above character for a two barrel carburetor wherein the throttle means for one of the carburetor barrels comprises a fixed orifice member and an axially movable coaxial closure member, and wherein the throttle means for the other carburetor barrel comprises a fixed closure member and an axially movable coaxial orifice member; and to provide such throttle means wherein the forces effected by the fuel flow acting on the movable members in the two carburetor barrels substantially counterbalance each other.

Other objects of this invention will appear in the following description and appended claims, reference being had to the accompanying drawings forming a part of this specification wherein like reference characters designate corresponding parts in the several views.

FIG. 1 is a fragmentary schematic sectional view through the axis of a fuel-air induction conduit for an automobile internal combustion engine, showing a throttle embodying the present invention at the wide open position.

FIGS. 2 and 3 are views similar to FIG. 1, showing modifications.

FIG. 4 is a view similar to FIG. 1, showing a pair of induction conduits for a multiple barrel carburetor showing a throttle embodying the present invention at the idle position in each conduit.

FIG. 5 is a fragmentary sectional view taken in the direction of the arrows substantially along the line 5—5 of FIG. 4.

FIG. 6 is a fragmentary sectional view taken in the direction of the arrows substantially along the line 6—6 of FIG. 4.

FIG. 7 is a fragmentary view similar to FIG. 4, showing a modification.

FIG. 8 is a diagram showing the relationship between manifold vacuum and air flow at various positions of throttle opening.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Referring to the drawings, an embodiment of the present invention is illustrated in FIG. 1 comprising a fuel-air induction passage or conduit 10 having an upstream air inlet 11 and a downstream fuel-air discharge opening 12 which communicates with the engine. Fuel may be supplied to the passage 10 by any conventional fuel metering system, as for example by fuel injection or carburetor induction. FIG. 1 shows a fuel injection system wherein a fuel metering and supply system 13 discharges liquid fuel at 14 in communication with a flexible conduit 15. The latter extends through the side wall of the passage 10 and has a free end secured within a movable retainer or carrier 16 for discharging axially downwardly through a restricted fuel injection nozzle 17 of the carrier 16. The latter is connected by a small bracket 18 with the upper end of a conical throttle valve member 19 having a rounded streamlined upper end immediately underlying the nozzle 17 to deflect fuel therefrom generally radially and uniformly within the conduit 10.

The valve member 19 extends coaxially within the conduit 10 and cooperates with an orifice or annular throttle member 20 to vary the central opening of the latter and thereby to control the flow of the fuel-air mixture therethrough. The upstream end of the member 20 enlarges radially at 21 to provide a shoulder adapted to seat upon a mating radial shoulder 22 integral with the side wall of the conduit 10. The outer circumference of the member 20 and of the enlargement 21 are cylindrical and closely interfit with the adjacent cylindrical surface of the conduit 10 to effect a high resistance annular flow passage between the member 20 and conduit 10, so that substantially all of the fuel-air flow within the conduit 10 passes through the central orifice of the member 20.

Relative axial movement between the members 19 and 20 is effected by a flexible cable or sprocket chain 23 extending within the conduit 10 and looping over a pulley 24 rotatably mounted on a shaft 25 that extends transversely within the conduit 10 at a fixed location somewhat above the maximum desired upstream position of member 19 at the wide open throttle position. One end of the cable 23 is secured coaxially within conduit 10 at 26 to an upper portion of the retainer 16. The opposite end of the cable 23 is secured at 27 to an upper portion of the enlargement 21. The shaft 25 is operatively connected with the customary throttle control level for the engine so as to rotate pulley 24 counterclockwise in a throttle opening movement or clockwise in a throttle closing movement.

The members 19 and 20 are shaped to comprise a variable restriction diffuser capable of conducting gas flow therebetween at the region of maximum restriction at sonic velocity throughout essentially the entire operating range of the engine. In a preferred construction, the member 19 coverges conically in the downstream direction at an angle approximating $3\frac{1}{2}°$ with respect to the axis of the conduit 10. From a region of maximum restriction, the orifice of the member 20 enlarges conically in the downstream direction at approximately the same angle with respect to the axis of conduit 10. Upstream of the region of maximum restriction, the orifice of the member 20 enlarges symmetrically with respect to the axis of the conduit 10 to effect the desired diffuser action in accordance with known principles.

Specifically, the diffuser 19,20 is designed for the engine and induction conduit 10 so as to effect substantially sonic velocity therethrough at its region of maximum restriction when the members 19,20 are at the wide open position, FIG. 1, with the enlargement 21 resting on the shoulder 22. It is to be noted that the region of maximum restriction for the diffuser 19,20 will always be the region of maximum restriction for the orifice member 20, although the maximum restriction will vary depending upon the relative axial position of the member 19.

As illustrated in FIG. 8, with most two barrel and single barrel carburetors, if substantially sonic velocity is achieved at wide open throttle, it will be achieved even more readily when the maximum diffuser restriction is increased. Most single and two barrel fuel-air inlet systems may be designed to operate at wide open throttle at approximately 3 inches of mercury vacuum, i.e. at a pressure equivalent to 3 inches of mercury below atmospheric pressure, downstream of the throttle or diffuser 19,20, i.e. at the discharge orifice 12. FIG. 8 shows that as the wide open throttle vacuum increases above approximately 3 inches of mercury downstream of the throttle 19,20, the rate of change of the inlet fuel-air flow with increasing vacuum becomes almost zero, indicating that sonic velocity has been achieved. Likewise as the throttle closes to decrease the total fuel-air flow, the approximate sonic velocity is more readily obtained at even higher pressures, i.e. at lesser vacuum pressures. Also as the throttle closes toward the idle condition, the downstream vacuum at the manifold region 12 actually increases, so that sonic velocity through the restricted portion of the diffuser is even more readily obtained at less than 3 inches mercury vacuum.

Although the air flow urges both diffuser member 19 and 20 downwardly to maintain the cable 23 taut, stablization of the member 19 and positive throttle opening and closing movements of these members in opposite directions may be assured by means of a second lower cable 28 that passes around a downstream pulley 29 journalled on a shaft 30 at a fixed location within the conduit 10 downstream of the diffuser 19,20. Opposite ends 31 and 32 of the cable 28 are secured to lower portions of the members 19 and 20 respectively so as to cooperate with the upper cable 23 to provide a closed loop, whereby as one of the members 19,20 moves in one direction, the other will necessarily move in the opposite direction. Also where desired, several guide vanes 33 integral with the enlargement 21 and extending upwardly therefrom and radially into the conduit 10 may be provided to maintain the member 19 in coaxial alignment as it moves upwardly toward the wide open position.

In accordance with the foregoing, liquid fuel or a fuel-air mixture discharging from nozzle 17 strikes the rounded upper end of member 19 and is deflected radially into the air stream entering via 11. The liquid fuel is further dispersed during its downward flow within conduit 10. At the region of sonic velocity in the restricted portion of the diffuser 19,20, the remaining liquid fuel droplets are fragmented as they flow into the downstream enlarging portion of the diffuser 19,20 and thence from the outlet 12 to the engine. It is also to be noted that the force exerted by cable 23 required to raise the member 19 in a throttle opening movement against the downward flow of the fuel-air mixture is counterbalanced by a substantially equal force exerted on the member 20. Similar counterbalancing of the throttle actuating force occurs during throttle closing. In this regard, the effective cross sectional areas of the members 19 and 20 exposed to the fuel-air flow are substantially equal.

FIG. 2 illustrates a modification of the present invention wherein the structure and operation are substantially the same as described above and corresponding parts are numbered as in FIG. 1. The principal difference in FIG. 2 is that instead of the flexible fuel conduit 15, a rigid conduit **15*a* communicates between the fuel inlet duct 14 and a fixed nozzle 17*a* that discharges axially in the downstream direction directly above the throttle member 19. The cable 23 bifurcates into portions 23*a* and 23*b* which extend to attachments with the upper end of member 19 at diametrically opposite locations as illustrated in FIG. 3 in order to avoid interference with the fixed conduit 15*a*. Also in FIG. 2, guide vanes 33*a* integral with the member 19 replace the guides 33 but serve the same purpose of maintaining the member 19 in coaxial alignment within the conduit 10**.

The devices of FIGS. 1 and 2 are primarily adapted for a single barrel induction conduit employed with fuel injection. The modification shown in FIG. 3 is substantially the same in operation and construction as described above in regard to FIGS. 1 and 2, but is adapted for use with a conventional carburetor where the primary fuel supply is induced into the conduit 10 by aspirator action at the throat of a venturi, as illustrated in FIGS. 4 and 5 by way of example. During idle operation when insufficient air flows through the fuel inducing venturi to supply fuel for idle, such fuel is supplied downstream of the throttle 19,20 in a fuel-air mixture by means of a conventional idle fuel system, as illustrated in FIG. 4. Preferably a transfer fuel supply port is provided to supplement the conventional idle system and supply increasing amounts of fuel to operate the engine when the throttle opens from the idle position to an intermediate position where the air flow through the fuel inducing venturi is insufficient to induce an adequate flow of operating fuel.

In FIG. 3, such transfer ports are provided in the throttle orifice member 20, which differs from the orifice member 20 of FIGS. 1 and 2 by the omission of the enlargement 21. Accordingly the annular or radial seat 22 shown in FIGS. 1 and 2 is not required. The passage 10 in FIG. 3 is cylindrical throughout the movement range of the member 20. Also in FIG. 3 and as shown in FIGS. 4 and 5, the primary fuel supply communicates with an idle fuel and air supply conduit 35 that extends axially within the wall of passage 10 to the aforesaid idle mixture port. An axially extending transfer slot 36 opens radially into the conduit 10 from the conduit 35 at the region of the orifice member 20. A transfer port or duct 37 extends radially through the member 20 at or slightly downstream of the latter's region of maximum restriction, so as to communicate with the slot 36 except when the member 20 moves downwardly below a predetermined intermediate position of throttle opening.

At the idle position shown in FIG. 3, port 36 is substantially closed by member 19, although if desired a small fuel flow from 36 into 37 may be permitted by suitably dimensioning the ports 36 and 37. Also the radial port 37 is substantially closed by the member 19 and very little air flows through the inducer 19,20. Accordingly, the major idle fuel is supplied downstream of the throttle at the aforesaid idle mixture port while up to 10% of the idle fuel may be supplied via 37.

As the throttle members 19,20 progressively move in a throttle opening direction from the idle position, port 37 progressively opens into passage 10 upon relative upward movement of member 19. Port 37 also progressively opens to port 36 as the member 20 moves downwardly. Simultaneously the restriction of the inducer 19,20 progressively decreases to enable increasing air flow therethrough, thereby to increase the fuel flow through conduit 38 progressively as required for increased engine operation until such time as the aforesaid primary fuel inducing venturi becomes effective to supply adequate fuel. As the venturi induced primary fuel flow begins to increase, the port 37 closes by moving below the lower end of slot 36, thereby to shut off the fuel flow via the transfer port 37.

Another type of transfer porting is illustrated in the right half of member 20 diametrically opposite the ports 36,37 and comprises an axial idle fuel-air conduit 35*a* comparable to the conduit 35, which communicates with the interior of conduit 10 via a radial transfer port 36*a* at a location adjacent and downstream of the maximum restriction for the diffuser 19,20 when these members are at the idle position shown. An air bypass duct 38 extends axially within the right half of member 20, opens radially at its upper end 38*a* toward the wall of conduit 10, and opens axially downwardly into the latter conduit. Above the transfer port 36*a*, an air bypass slot 39 is formed in the inner wall of the conduit 10 for conducting gas from above the member 20 into the port 38*a* when the member 20 moves downwardly from the idle position. Also at the idle position the outer cylindrical wall of the member 20 substantially (or completely if desired) closes the transfer port 36*a*, so that the idle fuel flow via 36*a* will usually not amount to more than 10% of the total. If desired, the slot 39 may open slightly at 39*a* above the member 20 at the idle position, thereby to reduce the vacuum in duct 38 and the consequent leakage of fuel thereinto from duct 36*a*. Such limited flow of bypass air via the slot 39 and thence via 38*a* and 38 to a downstream location of the induction conduit 10 may be nominal and may be eliminated entirely by dimensioning the slot 39 and member 20 so as to reduce or eliminate the opening 39*a* at the idle position.

As the throttle members 19 and 20 progressively open from the idle position shown, the port 39*a* progressively opens to increase the bypass air flow through conduit 38. Simultaneously the downward movement of member 20 progressively opens transfer port 36*a* into port 38*a* to effect a progressively increasing flow of transfer fuel by aspirator action down 38 into conduit 10. As the throttle diffuser members 19 and 20 continue to open, communication between port 38*a* and slot 39 is progressively closed by the upper cylindrical edge of member 20 to decrease the bypass air flow. Simultaneously port 36*a* continues to open to discharge the maximum transfer fuel into duct 38. Thereafter upon continued throttle opening, the upper end of member 20 gradually closes port 36*a* and eventually blocks the transfer fuel flow completely at a predetermined position of throttle opening whereat the aforesaid primary venturi induced fuel flow is effective to operate the engine. However, complete blockage of the transfer fuel flow via either 36 or 36*a* is not essential because the idle fuel flow is restricted at the outset. Thus a nominal leakage of fuel from the transfer port system during cruise conditions will not be objectionable.

Although the two types of transfer ports could be employed with a single carburetor, two are shown primarily for the sake of illustration. Ordinarily a single transfer system will be adequate to supply the required transfer fuel as the throttle opens from the idle position.

FIGS. 4, 5 and 6 illustrate a modification of the present invention adapted for use with a two barrel carburetor having the induction conduit 10 which bifurcates upstream of the fuel metering region into parallel passages 10*a* and 10*b*. Except for the throttle means described below, the carburetor may be conventional and provides immediately downstream of the air inlet 11 the usual choke valve 40 pivotal in passage 10 off center at 40*a*. The valve 40 may be thermostatically controlled, as for example by bi-metallic spring 41 and may also be responsive to manifold pressure by conventional means not shown.

A conventional fuel inducing venturi 42 is provided in an upstream region of each of the passages 10*a* and 10*b* and into which a primary fuel nozzle 43 extends for discharging fuel thereinto at 44 to operate the engine under normal cruise and load conditions. The nozzle 43 receives fuel through a restricted inlet 45 submerged below the fuel level 46 in a conventional fuel bowl 47, wherein the fuel level 46 is maintained substantially constant by float controlled means not shown. The fuel bowl may be vented to the atmosphere by a vent conduit 48, FIG. 6, which opens into the bowl 47 at a location above the fuel level 46 and extends into the substantially atmospheric pressure region of the conduit 10 at 49. Accordingly as the air flow through the venturi 42 increases with increasing engine load and throttle opening, metered fuel is discharged into the venturi restriction at 44 from the fuel bowl 47 via restriction 45 as a function of engine load.

A preliminary supply of air to facilitate dispersion of the fuel into a fine mist as it enters the venturi restriction may be provided via duct 50 which opens to the atmosphere at 50*a* and communicates with the nozzle 43 via a restriction 50*b*. A branch 51 of the duct 50 communicates with the idle fuel ducts 35 and 35*a* to supply a mixture of fuel and air thereto when the throttle is at the idle or closed position and insufficient air flows through either venturi 42 to induce adequate engine operating fuel thereinto at 44. In such a situation, the low pressure downstream of the throttle induces an idle fuel flow through conduits 35 and 35*a* into each of the conduits 10*a* and 10*b* at the corresponding downstream idle ports 52, which may be adjustably restricted by a needle valve 53 integral with an idle adjustment screw 54.

The throttle in each of the barrels 10*a* and 10*b* is similar to those described above except that in passage 10*a*, the inner conical closure member 19 is fixed by means of two or more brackets 55 secured at 56 to the interior wall of conduit 10*a* immediately below its venturi 42. The orifice member 20 is movable as described above and is secured at its upper end to the arms 57*a* and 57*b* of a yoke which is connected at 58*a* to the lower end of a connector 59*a*. The upper end of the connector 59*a*, which may be a rod or cable, is secured at 60*a* to the left end of a beam 60 pivotal at 61 on a central portion of the passage 10 that partitions the latter into the separate barrels or passages 10*a* and 10*b*. A lever arm 62 of the beam 60 extends at right angles thereto and is provided with means 63 for connecting with the engine throttle mechanism.

In the conduit 10*b*, the orifice member 20 comprises an integral part of the conduit 10*b*. In other respects it operates in the manner of the relatively movable orifice members 20 described above. A central orifice restricting member 19 is connected by means of streamlined brackets 64 with guide-shoes 65 in sliding engagement with the interior wall of the chamber 10*b* for sliding axially therein. A connector 66 is secured at its lower end 67 to the upper end of the movable member 19 and is secured at its upper end to the right end 60*b* of the beam 60, such that upon counterclockwise pivoting the beam 60, the member 19 is pulled axially upward within conduits 10*b* and the orifice member 20 is lowered within the conduit 10*a*.

In FIG. 4, the throttle members 19,20 in both of the conduits 10*a* and 10*b* are at the closed or idle position, whereat the movable member 20 in conduit 10*a* is at its upper most position and the movable member 19 is at its lower most position in conduit 10*b*. Accordingly the throttling or restriction of each of the diffusers 19,20 within the conduits 10*a* and 10*b* is at a maximum. Upon counterclockwise pivoting of beam 60 in a throttle opening movement, the movable orifice member 20 is lowered with respect to the fixed closure member 19 in conduit 10*a*, and the movable closure member 19 in conduit 10*b* is raised with respect to the fixed orifice member 20. If the connector 59*a* and yoke 57*a,b* and also connector 66 are of rigid material, the counterclockwise throttle opening movement of beam 60 positively moves the movable orifice member 20 downwardly in conduit 10*a* upon the simultaneous upward movement of the closure member 19 in conduit 10*b*.

As described above in regard to the counterbalancing effects in FIGS. 1–3, the downward flow of air in conduit 10*a* urges the movable orifice member 20 downwardly, so that the connector 59*a* and yoke 57*a,b* may be flexible cable or chains. Similarly upon clockwise throttle closing movement of the beam 60, downward movement of the closure member 19 is urged positively by the downward flow of the fuel-air mixture, so that the connector 66 may also comprise a flexible chain or cable.

It is also apparent that by suitably dimensioning the effective cross-sectional areas of the movable members 19 and 20, the force required to be exerted by the beam 60 to move one of the latter members upward against the fuel-air flow is counterbalanced by the force of the fuel-air flow urging the other member downwardly. By virtue of the engagement between the shoes 65 and the inner cylindrical wall of the passage 10*b*, guide vanes similar to the vanes 33 or 33*a* are not essential for the movable member 19, but may be employed if desired.

Also for reasons similar to those applicable to pulley 29, a pair of pulleys 69*a* and 69*b* may be journaled on a corresponding pair of shafts 70*a* and 70*b* located downstream of the throttle members in the passages 10*a* and 10*b* respectively, such that a flexible cable or sprocket chain 71 located around the pulleys 69*a,b* may extend coaxially within the two passages 10*a* and 10*b*. One end of the cable 71 may be secured at 72*b* to the lower end of the movable member 19 in passage 10*b*. The other end of cable 71 bifurcates at 72 downstream of the lowermost end of the fixed member 19 in passage 10*a* to effect branching cables 71*a* and 71*b* secured at their upper end at diametrically opposite locations 73*a,b* to the lower end of the movable orifice member 20, thereby to effect a closed force circuit through the beam 60 and to assure positive downward movement of either of the movable members 19 and 20 when the other thereof is pulled upward by rocking of the shaft 60.

Similarly to the transfer port 37 in FIG. 3, a transfer port 74 is provided radially in the fixed orifice member 20 of FIG. 4 to connect the idle fuel passage 35*a* with the interior of diffuser 19,20 at the region of its maximum restriction in passage 10*b*. At the idle position shown, the air flow through the passage 10*b* diffuser is nominal and fuel flow from conduit 35*a* into passage 10*b* via 74 is also nominal. The primary idle fuel is thus provided via port 52. As the beam 60 rotates counterclockwise in a throttle opening movement, the opening of passage 74 into the associated diffuser progressively increases. Simultaneously the restriction for that diffuser decreases to progressively increase the fuel flow through transfer port 74. During that time, the pressure at 52 increases to reduce the fuel supplied therethrough. Eventually air flow through venturi 42 and the primary fuel flow induced thereby at 44 from nozzle 43 will increase until at cruising or accelerating conditions of throttle opening, the fuel supply via 44 in passage 10*b* will be the major source of operating fuel. The proportion of fuel supplied via 74 will be nominal and practically no fuel will be supplied via 52.

In passage 10*a* of FIG. 4, a transfer port system similar to that illustrated at the right half of FIG. 3 is provided comprising a radial transfer port 75 connecting the idle fuel conduit 35 with the interior of passage 10*a* adjacent and downstream of the region of maximum restriction for the diffuser 19,20 in passage 10*a*. At the idle position of the movable orifice member 20, the latter substantially, or if desired, completely closes port 75 into the passage 10*a*. Upstream of the port 75, the sidewall of the passage 10*a* is provided with an axially extending slot 76 which connects the interior of passage 10*a* with the radial upstream opening 77*a* of an axially extending bypass port 77 in the movable orifice member 20. The passage 77 extends downwardly from port 77*a* completely through the member 20 and opens into the passage 10*a* downstream of the aforesaid region of maximum restriction for the associated diffuser 19,20.

At the idle position, bypass air will flow through slot 76, port 77*a* and passage 77 to bypass the throttle members 19 and 20. However, as described above in regard to port 39*a*, slot 76 may be dimensioned so as to close or nearly close the bypass opening into port 77*a* at the idle position. As the member 20 in passage 10*a* moves downwardly in a throttle opening movement, the opening of passage 75 into passage 77 progressively increases to enable a progressively increasing flow of fuel during the transfer operating range between idle and engine cruising conditions. Upon continued downward opening movement of the movable member 20, the latter's upper end gradually closes orifice 77*a* to the bypass air flow and the transfer port 75 will be substantially unrestricted to effect maximum flow of transfer fuel.

At the same time the flow of idle fuel through the restricted port 52 in passage 10*a* will progressively decrease as the pressure within passage 10*a* at port 52 gradually increases with progressive throttle opening. Finally, as the throttle opening progresses to the extent that the air flow in venturi 42 induces adequate fuel from port 44 to operate the engine at the cruise condition, the upper outer cylindrical portion of the movable member 20 closes the transfer passage 75 and reduces the transfer fuel flow therethrough.

FIG. 7 illustrates a modification similar to that shown in FIGS. 4–6, except that instead of the beam 60 and associated connection with the movable diffuser members, the upper end of the partition between passages 10*a* and 10*b* is provided with a cross arm 80 on which pulleys 81*a* and 81*b* are journalled at 82*a* and 82*b* respectively. A cable 83 loops around the pulleys 81*a,b* with its opposite ends coaxial with the passages 10*a* and 10*b* respectively. The end of cable 83 in passage 10*a* bifurcates at 84 to provide portions 83*a* and 83*b* connected respectively to diametrically opposite edges of the upper end of movable orifice member 20. The opposite end of cable 83 is connected to the top of movable member 19, as at 67 in FIG. 4.

In other respects, the operation in FIG. 7 is the same as described above and corresponding ports are correspondingly numbered. The pulleys 82*a,b* are operatively connected with the throttle operating linkage to move the movable members 19 and 20 axially within their respective passages 10*b* and 10*a*. If desired, the lower ends of the movable members 19 and 20 may be connected with a cable 71 looped around pulleys 69*a,b* as in FIG. 4.

I claim:

1. In a fuel supply means for an automobile engine, inlet induction passage means, fuel supply means for supplying fuel to said passage means, said passage means having upstream inlet means for receiving air and having two downstream outlet conduits for discharging a fuel-air mixture, means defining a part of each outlet conduit downstream of said fuel supply means comprising an orifice member and an associated closure member arranged for relative movement with respect to each other axially of their associated conduit, each orifice member having an orifice for conducting the flow of said mixture therethrough, each closure member being cooperable with its associated orifice member to effect a variable restriction for the associated orifice in accordance with the relative axial positions of said members, and means for effecting said relative movement to decrease or increase the restrictions of the two orifices in unison comprising means for connecting the orifice member in one outlet conduit with the closure member in the other outlet conduit for moving one of the last named two members in the direction of the mixture flow in the associated outlet conduit and for simultaneously moving the other of the last named two members oppositely to the direction of the mixture flow in the associated outlet conduit.

2. In the combination according to claim 1, each pair of associated members defining a part of each conduit comprising one fixed and one axially movable member.

3. In the combination according to claim 2, said members being dimensioned for substantially counterbalancing the force required to move either member against said flow by moving the other member with said flow.

4. In the combination according to claim 1, each orifice member having an orifice coaxial with its associated conduit, each closure member being coaxial with the orifice of its associated orifice member and cooperating therewith to provide an annular restricted gas flow passage having inner and outer sidewalls diverging sufficiently gradually in the axial direction of flow to effect approximately sonic flow for said mixture at the region of minimum cross sectional area for said passage throughout the operating range of relative axial positions of said members.

5. In the combination according to claim 4, said members being dimensioned for substantially counterbalancing the force required to move either member against said flow by moving the other member with said flow.

6. In the combination according to claim 5, the orifice and closure member associated with each outlet conduit being dimensioned to effect a maximum restriction for the associated orifice when at a predetermined location with respect to each other and to decrease said restriction for each orifice progressively upon said relative movement of said movable members from said predetermined location.

7. In the combination according to claim 1, the relatively movable members of each outlet conduit comprising a variable geometry flow diffuser for conducting said flow therethrough at approximately sonic velocity at its region of minimum cross sectional area.

8. In the combination according to claim 7, one of the two members of each conduit being fixed with respect to that conduit and the other being movable axially therein, said means for effecting said relative movement comprising operating means.

9. In the combination according to claim 8, said operating means comprising first and second flexible tension exerting means, said first flexible means having opposite ends connected to one of each of said movable members and extending from said ends in one axial direction with respect to said flow, said second flexible means having opposite ends also connected to one of each of said movable members and extending from the latter opposite ends in the axial direction opposite said one axial direction with respect to said flow, said movable members and flexible means completing a closed loop, and means for assuring the simultaneous movement of said movable members comprising guide means for supporting said flexible means in movable relationship in said closed loop.

10. In the combination according to claim 1, the relatively movable members of each outlet conduit comprising a variable geometry flow diffuser for conducting said flow therethrough at approximately sonic velocity at its region of minimum cross sectional area, the associated orifice member and closure member of one of said conduits comprising a coaxial movable annular member and a fixed closure member respectively, the associated orifice member and closure member of the other of said conduits comprising a coaxial fixed annular member and a movable closure member, the fixed closure member cooperating coaxially with the orifice of the movable annular member to progressively restrict that orifice upon axial movement of the latter member in one direction with respect to the flow in said one conduit, the movable closure member cooperating coaxially with the orifice of the fixed annular member to progressively restrict that orifice upon axial movement of the movable closure member in the direction opposite said one direction with respect to said flow through the last named orifice.

11. In the combination according to claim 8, each closure member having an outer surface cooperating with the inner surface of the coaxial annular member to comprise an annular flow passage defining the flow diffuser in the associated conduit, said members being dimensioned for substantially counterbalancing the force required to move either member against said flow by moving the other member with said flow.

12. In the combination according to claim 8, said means for supplying fuel having a supply port opening into said passage means for supplying said fuel thereto upstream of said flow diffusers and also comprising a transfer port opening into the outlet conduit containing said movable orifice member for supplying fuel to the latter conduit downstream of said supply port, a bypass conduit in said movable orifice member opening into said latter conduit downstream of said transfer port at all operative positions of said movable orifice member, said bypass conduit opening into said latter conduit upstream of said transfer port when said movable member is at a location of maximum restriction for the associated flow diffuser, and means for controlling fuel flow from said transfer port into said bypass conduit to increase that flow upon opening movement of said movable member from the position of maximum restriction for said diffuser to a predetermined position of intermediate restriction comprising valve portions of said movable orifice member and said latter outlet conduit cooperable for controlling the communication between said bypass conduit and said latter outlet conduit upstream of said transfer port and also for controlling the communication between said transfer port and bypass conduit.

13. In the combination according to claim 12, said valve portions comprising means for effecting communication between said bypass conduit and said latter outlet conduit upstream of said transfer port when said movable orifice member is at said position of maximum restriction, or progressively closing the last named communication upon opening movement of said movable orifice member toward said predetermined intermediate restriction, and for progressively opening the communication between said transfer port and bypass conduit as said movable member moves toward said position of intermediate restriction.

14. In the combination according to claim 13, said valve portions also comprising means for progressively closing said communication between said transfer port and bypass conduit upon opening movement of said movable orifice member beyond said position of intermediate restriction.

15. In the combination according to claim 8, said means for supplying fuel having a fuel supply port opening into said conduit means for supplying said fuel thereto upstream of said flow diffusers and also comprising a transfer port opening into the orifice of said fixed orifice member for supplying fuel thereto adjacent the region of maximum restriction of said flow diffuser, said fixed orifice member and movable closure member having cooperating portions for substantially closing the communication between said transfer port and orifice when said movable closure member is at a location of maximum restriction for said flow diffuser and for progressively opening the last named communication upon opening movement of said movable closure member from said location.

* * * * *